US005419460A

United States Patent [19]

Herold et al.

[11] Patent Number: 5,419,460

[45] Date of Patent: * May 30, 1995

[54] CONTAINER FOR FLOWABLE SUBSTANCES

[75] Inventors: Wolf-Dietrich Herold, Seefeld; Guenter Rehfeld, Diessen; Gerd Brandhorst, Munich, all of Germany

[73] Assignee: Thera Patent GmbH & Co. KG Gesellschaft Fuer Industrielle Schutzrechte, Seefeld, Germany

[ * ] Notice: The portion of the term of this patent subsequent to Jul. 26, 2011 has been disclaimed.

[21] Appl. No.: 206,928

[22] Filed: Mar. 7, 1994

Related U.S. Application Data

[62] Division of Ser. No. 971,551, Nov. 5, 1992, Pat. No. 5,332,122.

[30] Foreign Application Priority Data

Nov. 12, 1991 [DE] Germany ..... 9114084 U
Jan. 17, 1992 [DE] Germany ..... 9200521 U

[51] Int. Cl.[6] ..... B65D 35/56

[52] U.S. Cl. ..... 222/105; 222/326; 222/386

[58] Field of Search ..... 222/105, 325, 326, 327, 222/386

[56] References Cited

U.S. PATENT DOCUMENTS

| | | | |
|---|---|---|---|
| 3,838,796 | 10/1974 | Cohen | 222/105 |
| 3,974,943 | 8/1976 | Wilston | 222/103 |
| 4,176,754 | 12/1979 | Miller | 215/11 |
| 4,231,492 | 11/1980 | Rios | 222/1 |

FOREIGN PATENT DOCUMENTS

| | | | |
|---|---|---|---|
| 0378806 | 7/1990 | European Pat. Off. . | |
| 0441538 | 8/1991 | European Pat. Off. | 222/105 |
| 2134871 | 12/1972 | France | 222/325 |
| 7419062 U | 6/1974 | Germany . | |
| 3500625A1 | 8/1985 | Germany . | |
| 8714014 U | 2/1988 | Germany . | |
| 8901554 U | 7/1989 | Germany . | |
| 3823708A1 | 1/1990 | Germany . | |
| 3826887A1 | 1/1990 | Germany . | |
| 7512255 | 4/1977 | Netherlands | 222/325 |
| 2092236 | 8/1982 | United Kingdom | 222/325 |

*Primary Examiner*—Andres Kashnikow
*Assistant Examiner*—Joseph A. Kaufman
*Attorney, Agent, or Firm*—Foley & Lardner

[57] ABSTRACT

The container includes a film tube 11 for flowable substances. The film tube is opened and placed in a cylindrical housing 31 between a cap 33 and a movable piston 32. At the end facing the cap 33, the tube 11 is provided with a ring 20 which has a conical sealing surface 21. When the piston 32 is advanced to dispense the content of the tube 11, the sealing surface 21 is forced against a complementary conical counter surface 35 formed in the cap 33 and surrounding an outlet. The content of the tube 11 is thus prevented from reaching the inner wall of the housing.

6 Claims, 2 Drawing Sheets

CONTAINER FOR FLOWABLE SUBSTANCES

This application is a division of application Ser. No. 07/971,551, filed Nov. 5, 1992, now U.S. Pat. No. 5,332,122.

BACKGROUND OF THE INVENTION

The invention relates to a container with a film tube for receiving a flowable substance. Containers of this type are used as disposable packages for sealing and moulding compositions or other curable substances.

German Offenlegungsschrift No. 3,823,708 discloses containers for separately receiving pasty components which components can be dispensed and supplied to a mixer in an exactly defined volume ratio. Each component is contained in a rigid cartridge which is provided at its one end by a dispensing nozzle and closed at its other end by a movable piston.

The known container permits an exact metering of the components, but is relatively expensive and requires manufacturing with close tolerances to achieve a sufficient sealing of the piston. Moreover, when rigid cartridges are used as one-way containers, they constitute a disposal problem that is taken more and more seriously.

For these reasons, film tubes are nowadays preferred as one-way packages for flowable substances, which are placed in cylindrical chambers and cut open to have their contents pressed out. With such containers, only the film tube forms a disposable part which is inexpensive and requires only little space when empty. Containers of this type are described, for instance, in German Offenlegungsschrift No. 3,826,887, German Utility Model No. 8,901,554, and U.S. Pat. No. 3,838,796.

The known containers using film tubes, however, are disadvantageous in that the substance emerging from the tube is prone to contaminate the interior of the cylindrical chamber and after some time will impede the movement of the piston, thereby rendering the container inoperative. Because part of the substance will not pass through the dispensing nozzle but escape into the interior of the cylindrical chamber, no exact metering of the substance is possible. This is a serious disadvantage particularly with substances which form one component of a material that is to be mixed at an exact ratio.

To avoid these disadvantages, the German company Teroson uses a tube package for distributing its sealing materials, which has a ring externally adhered to one end of the tube. The ring is threaded for connection to a dispensing nozzle. The dispensing nozzle includes blades which during screwing cut an opening into the film tube within the ring. Upon cutting, it is necessary for the dispensing nozzle to be screwed off again to remove the cut-off piece of film, which would otherwise clog the dispensing nozzle. This handling is very cumbersome and dirty.

A similarly designed tube package, which is similarly awkward to handle, is known from German Offenlegungsschrift No. 3,500,625.

SUMMARY OF THE INVENTION

It is an object of the invention to provide a container for a flowable substance which uses but a small amount of disposable material, yet allows simple and clean handling and accurate metering of the substance.

This object is met by a container for flowable substances, which comprises a film tube for receiving the substance, a cylindrical housing for receiving the tube between a movable piston and a rigid cap provided with a dispensing opening, and a ring mounted on the end of the tube facing the cap, wherein the ring has a conical sealing surface and the cap has a complementary conical counter surface co-operating therewith and surrounding the dispensing opening of the container.

In use of the container according to the invention, the film tube is cut open inside the ring and then inserted into the cylindrical housing in such a way that the sealing surface of the ring is placed against the counter surface of the rigid cap.

A conical sealing surface is advantageous in that the tube is automatically centered when inserted into the housing. The conical form of the sealing surfaces further causes an increase in the sealing pressure. The substance contained in the tube is thus prevented from contaminating the interior of the housing, specifically the sliding surfaces of the piston. The empty tube can be removed without problem and without adhering to the inner wall of the housing, as would happen with conventional containers. The sealing function of the ring ensures precise metering of the substance. Moreover, the ring prevents the cut film tube from being torn open excessively.

In a preferred embodiment of the invention, the ring is sealingly adhered to the tube and has a circumferential edge tapering towards the tube for sealingly engaging the same. A tight and stable fixing of the ring to the film tube is thereby achieved.

In other embodiments of the invention, the tube is closed by a clip and the ring is provided with a spacer the inner size of which is smaller than the outer size of the clip. The spacer may be formed as a resilient detent which permits the ring to be slid over the clip onto the tube but prevents the ring from sliding back. Further, the spacer may be provided with a notch at the location where the tube may be opened by cutting off the part closed by the clip. The ring may be composed of two half rings. In these embodiments, the part of the film tube strapped by the clip may be easily cut off at a defined location by means of cutting pliers or scissors to open the tube. During this operation, the ring prevents excessive opening of the tube and premature escape of the content.

DETAILED DESCRIPTION OF PREFERRED EMBODIMENTS

Figure 1:
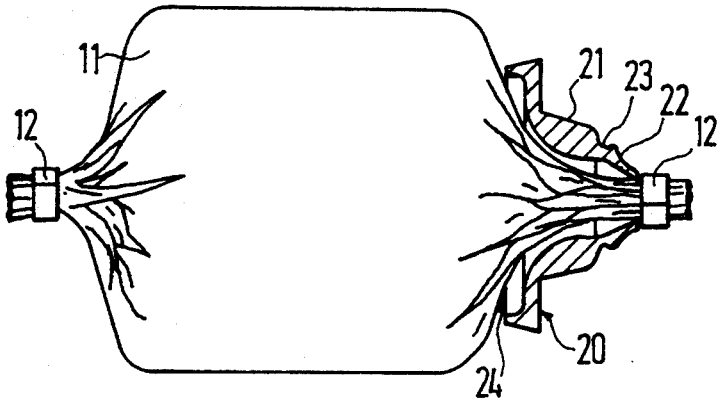
FIG. 1 illustrates a closed film tube with a ring shown in section.

As shown in FIG. 1, a film tube 11 is closed off at both ends by means of a clip 12. A ring 20 is provided at the dispensing end 29 of the tube between the filled portion of the tube 11 and the clip 12. The ring 20 abuts the tube 11 with a narrow edge 24. At the edge 24, the ring 20 is connected to the dispensing end of the tube 11 by an adhesive.

The ring 20 is provided with two tongue-shaped detents 22 which serve as spacers with respect to the clip 12. Thus, the clip 12 cannot slide into the interior of the ring. This facilitates the opening of the tube 11 by cutting-off the portion that is strapped and closed by the clip 12.

For convenient handling, the ring 20 is provided with notches 23 in the area of the spacers 22, which notches may be engaged by a pair of scissors or cutting pliers when cutting the tube 11 open, thereby avoiding the danger of the scissors or pliers slipping. During the manufacture of the package, the detents 22 may be elastically bent outwardly to permit the ring 20 to slide over the closed clip 12 onto the tube 11 where it is fixed by an adhesive. The adhesive prevents the ring 20 from becoming loose when the tube 11 is cut open.

Figure 2:
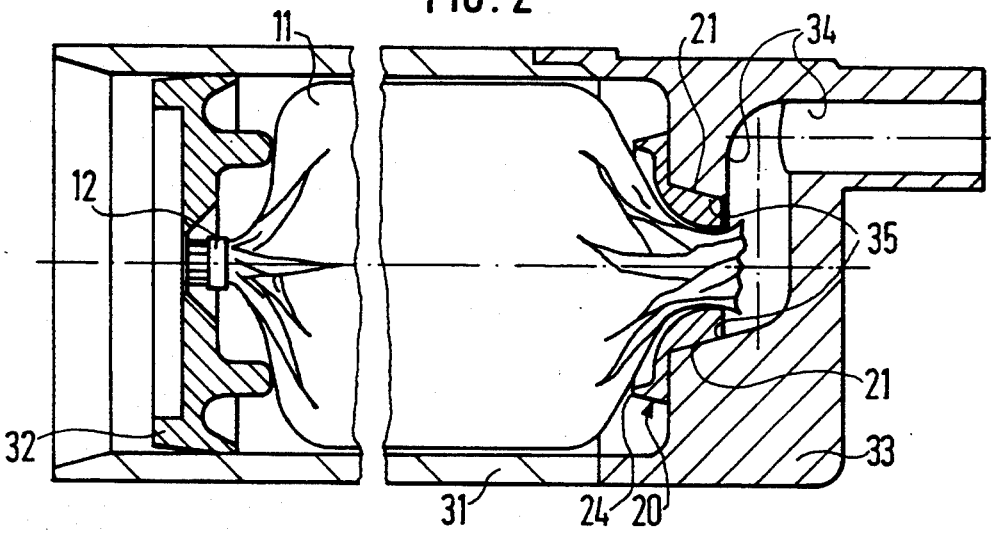
FIG. 2 is a sectional view of a container with the film tube which has not been shown in section, for reasons of clarity.

FIG. 2 shows the opened tube 11, situated in a cylindrical housing 31, with the longitudinal axis of both the tube 11 and the housing being indicated at 28. In this position, the conical sealing surface 21 of the ring 20 is in close sealing contact with a complementarily shaped conical counter surface 35 of a cap 33 provided at the end of the housing. The counter surface 35 surrounds an outlet 34 formed in the cap 33 for dispensing the substance from the tube 11.

The outlet 34 is formed as a bent channel which permits the substances of two adjacent containers of the type described to be simultaneously supplied to a mixer (not shown) through closely adjacent channels. The bent arrangement of the outlet channels 34 is thus advantageous in containers for multiple-component materials.

The content of the tube 11 may be dispensed by applying pressure to a piston 32 provided at the other end of the container. During this action, the ring 20 has its conical sealing surface 21 forced against the counter surface 35 and wedged into the cap 33. Furthermore, due to the small area of the edge 24, which tapers towards the film tube 11, a high sealing pressure is effective between the ring 20 and the dispensing end of the tube 11. As a result, the content of the tube 11 cannot pass either between the ring 20 and the cap 33 or between the film tube 11 and the ring 20, and therefore does not reach the inner wall of the housing 31. The empty tube 11, which is removed from the housing 31 upon withdrawal of the piston 32, is not contaminated externally. Likewise, the inner wall of the housing 31 is kept free of contamination by the content of the film tube 11, which could otherwise impede the movement of the piston 32.

The ring 20 adheres to the tube 11 and is removed with the same. Disposable parts are thus constituted only by the film tube 11 with the two clips 12 and the ring 20. Depending on the desired opening size of the tube 11, the ring may be designed as small as possible to limit the amount of waste.

Figure 3:
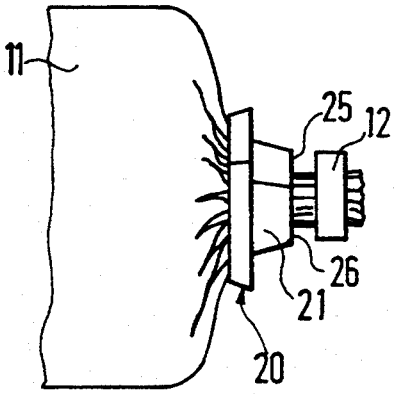
FIG. 3 is a partial view of a closed tube including the ring.

FIG. 3 is a partial view of a film tube 11 which is provided with a very small ring 20. The inner diameter of the ring is smaller than the outer diameter of the clip 12. The use of a spacer, such as shown at 22 in FIG. 1, is thus superfluous. The absence of a spacer permits the ring 20 to be flat so that the filling space of the tube 11 is hardly restricted.

To enable the ring 20 to be mounted after the tube 11 has been closed by the clip 12, the ring of this embodiment consists of two semi-annular parts 25 and 26. The two parts are glued or clamped together after placing round the tube 11.

In use, the two ring parts 25 and 26 are pressed firmly together by the co-operation between the conical sealing surface 21 and the complementary counter surface 35, so that the connection between the ring parts 25 and 26 becomes very tight.

Figure 4:
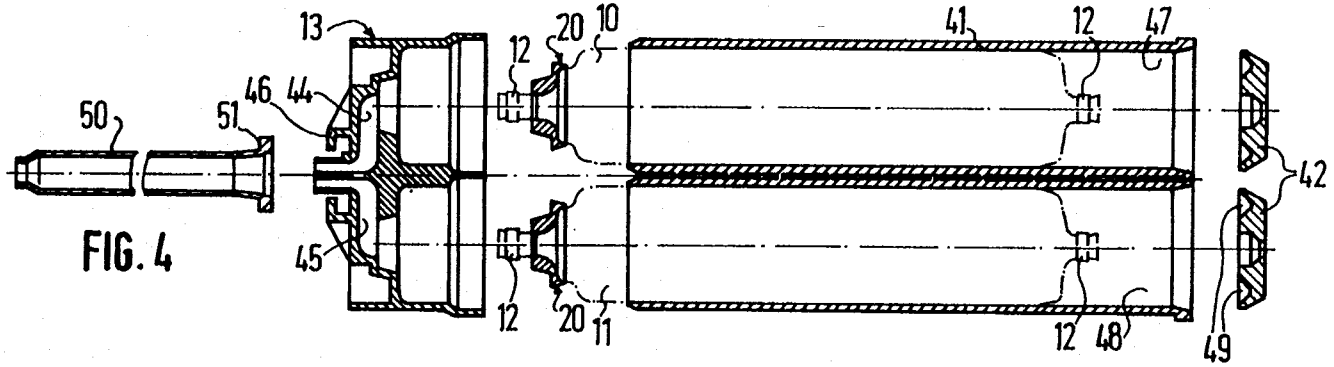
FIG. 4 is a sectional representation of a container for a two-component substance.

FIG. 4 is an exploded view of a container for a two-component substance. One film tube 11 is provided for each component and either tube is closed by a clip 12 and provided with a ring 20 as described above.

Either one of the tubes 11 is placed in one of a pair of cylindrical chambers 47, 48 of a double housing 41, and the other tube 11 in the other chamber. A cap 43 is provided at one end of the double housing 41 which has an outlet 44, 45 for either one of the cylindrical chambers 47, 48.

Both outlets 44, 45 are formed as bent channels which lead into a nozzle 50 in closely adjacent relationship. A bayonet socket 51, 46 is provided for fixing the nozzle 50 on the cap 43. A screw connection may be provided instead of a bayonet-type socket.

A piston 42 is inserted in each chamber 47, 48. On the side facing the tube 11, the piston 42 is profiled in such a way that it forms recesses in a central area to receive the clip 12 of the film tube 11 and in a peripheral area to receive the film material of the tube 11 as it is compressed. This permits the substance contained in the tube 11 to be dispensed as completely as possible.

Figure 5:
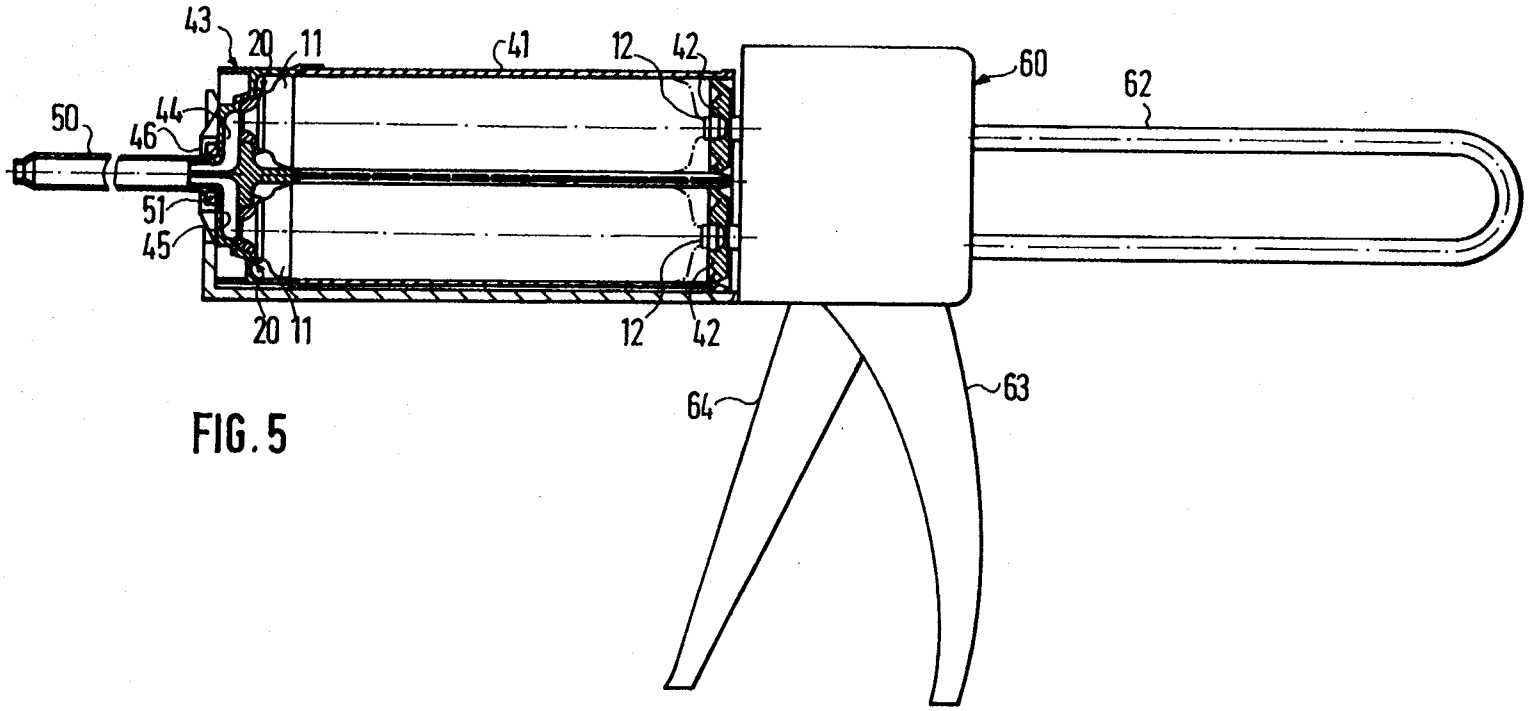
FIG. 5 shows the container for the two-component substance, inserted in a metering gun.

The container, which is shown in FIG. 4 in a disassembled condition, is represented in FIG. 5 assembled and placed in a metering gun 60. Both pistons 42 are actuated in common by a single U-shaped piston rod 62, which is advanced in steps by pulling the advancing lever 64 against the gun handle 63.

Mixer vanes (not shown) are arranged inside the tubular nozzle 50 to mix the two-component substance while it flows through the nozzle 50. The nozzle 50 thus forms a static mixer of the type disclosed in European Patent Application, Publication No. 0,378,806.

In the embodiment shown, the two outlets 44, 45 open into the nozzle 50 in side-by-side relationship. Improved mixing of the two components can be achieved by shaping the cap 43 so that the two outlets lead into the nozzle 50 in a concentric relationship.

In case of hardening two-component substances, the nozzle 50 is a disposable part, in addition to the film tube 11 and the rings 20. However, for the cap 43 to be re-usable, it is suitable if the film tubes 11 are of equal size as in the present embodiment, to code the film tubes 11, the cylindrical chambers 47, 48, and the two parts of the cap 43 with different colors. The user will then arrange the two components of the substance always on the same sides of the cap 43. This will avoid cross-contamination between the components within the outlets 44, 45 and thus prevent curing and clogging of the outlets and the nozzle 50.

The mixing ratio of the two components is 1:1 in the present embodiment. For other mixing ratios, film tubes 11 of correspondingly different diameters are required. In this case confusion is avoided even without a color coding.

We claim:

1. The combination comprising:

a film tube for receiving a substance and closed at one end, said tube having a longitudinal axis, an outer periphery, and a dispensing end including a discharge opening through which the substance is dispensed, and a ring mounted at the dispensing end of said tube, said ring having a longitudinal axis coincidental with the longitudinal axis of said tube, said ring having a main body and an annular sealing edge which extends generally perpendicular to said main body in the region of said main body where said sealing edge is located, said annular sealing edge sealingly engaging said dispensing end of said tube between said longitudinal axis of said tube and said outer periphery in the direction of said dispensing end, whereby said sealing edge prevents substance discharged from said tube through said discharge opening and traveling along said periphery from traveling past said sealing edge, thereby avoiding contact between said substance and the remainder of the outer periphery of said tube.

2. The combination of claim 1, wherein said sealing edge is tapered towards said tube.

3. The combination of claim 1, wherein said tube is closed at its dispensing end by a clip, and said ring is provided with a spacer the inner size of which is smaller than the outer size of said clip.

4. The combination of claim 3, wherein said spacer is formed as a resilient detent which permits said ring to be slid over said slip onto said tube but prevents said ring from sliding back.

5. The combination of claim 3, wherein said spacer is provided with a notch to assist opening said tube by cutting-off the part closed by said clip.

6. The combination of claim 1, wherein said ring is composed of two half rings.

* * * * *